US005588615A

United States Patent [19]

Batts

[11] Patent Number: 5,588,615

[45] Date of Patent: Dec. 31, 1996

[54] ROTATABLE PAPER ROLL HOLDER

[76] Inventor: Curtis L. Batts, 407 S. Alexander Ave., Duncanville, Tex. 75116

[21] Appl. No.: 409,430

[22] Filed: Mar. 24, 1995

[51] Int. Cl.[6] ..... B65H 19/10

[52] U.S. Cl. ..... 242/598.3; 242/591

[58] Field of Search ..... 242/229, 591, 242/592, 598, 598.3, 598.5, 599.3

[56] References Cited

U.S. PATENT DOCUMENTS

| | | | |
|---|---|---|---|
| 1,986,500 | 1/1935 | Charbonneau | 242/591 |
| 4,103,838 | 8/1978 | Young . | |
| 4,241,885 | 12/1980 | Robinson | 242/591 |
| 4,270,706 | 6/1981 | Robinson . | |
| 4,373,682 | 2/1983 | Dickson . | |
| 5,054,676 | 10/1991 | Ban . | |
| 5,149,003 | 9/1992 | Tharp . | |

FOREIGN PATENT DOCUMENTS

| | | | |
|---|---|---|---|
| 1133009 | 3/1957 | France | 242/229 |
| 410519 | 2/1947 | Italy | 242/229 |
| 441581 | 8/1949 | Italy | 242/229 |

*Primary Examiner*—John P. Darling

[57] ABSTRACT

A rotatable paper roll holder for rotatably supporting a roll of paper for dispensing of the paper either from over or from under the roll includes a mounting assembly for securing to a support surface such as a vertical wall. A yoke supports a spindle upon which a roll of paper can be rotatably positioned. An adjustable angle coupling secures the yoke to the mounting assembly and permits rotation of the yoke about an axis directed orthogonally through the spindle such that the paper roll can be oriented to unroll paper either from over or from under the roll as desired.

5 Claims, 2 Drawing Sheets

ROTATABLE PAPER ROLL HOLDER

BACKGROUND OF THE INVENTION

1. Field of the Invention

The present invention relates to roll holding devices and more particularly pertains to a rotatable paper roll holder for rotatably supporting a roll of paper for dispensing of the paper either from over or from under the roll.

2. Description of the Prior Art

The use of roll holding devices is known in the prior art. More specifically, roll holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art roll holding devices include U.S. Pat. No. 5,149,003; U.S. Pat. No. 5,054,676; U.S. Pat. No. 4,373,682; U.S. Pat. No. 4,270,706; and U.S. Pat. No. 4,103,838.

While these devices fulfill their respective, particular objectives and requirements, the aforementioned patents do not disclose a rotatable paper roll holder for rotatably supporting a roll of paper for dispensing of the paper either from over or from under the roll which includes a mounting means for securing to a support surface, a yoke supporting a spindle upon which a roll of paper can be rotatably positioned, and an adjustable angle coupling means for securing the yoke to the mounting means and for permitting rotation of the yoke about an axis directed orthogonally through the spindle such that the paper roll can be oriented to unroll paper either from over or from under the roll as desired.

In these respects, the rotatable paper roll holder according to the present invention substantially departs from the conventional concepts and designs of the prior art, and in so doing provides an apparatus primarily developed for the purpose of rotatably supporting a roll of paper for dispensing of the paper either from over or from under the roll.

SUMMARY OF THE INVENTION

In view of the foregoing disadvantages inherent in the known types of roll holding devices now present in the prior art, the present invention provides a new rotatable paper roll holder construction wherein the same can be utilized for rotatably supporting a roll of paper for dispensing of the paper either from over or from under the roll. As such, the general purpose of the present invention, which will be desert bed subsequently in greater detail, is to provide a new rotatable paper roll holder apparatus and method which has many of the advantages of the roll holding devices mentioned heretofore and many novel features that result in a rotatable paper roll holder which is not anticipated, rendered obvious, suggested, or even implied by any of the prior art roll holding devices, either alone or in any combination thereof.

To attain this, the present invention generally comprises a rotatable paper roll holder for rotatably supporting a roll of paper for dispensing of the paper either from over or from under the roll. The inventive device includes a mounting assembly for securing to a support surface such as a vertical wall. A yoke supports a spindle upon which a roll of paper can be rotatably positioned. An adjustable angle coupling secures the yoke to the mounting assembly and permits rotation of the yoke about an axis directed orthogonally through the spindle such that the paper roll can be oriented to unroll paper either from over or from under the roll as desired.

There has thus been outlined, rather broadly, the more important features of the invention in order that the detailed description thereof that follows may be better understood, and in order that the present contribution to the art may be better appreciated. There arc, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rotatable paper roll holder apparatus and method which has many of the advantages of the roll holding devices mentioned heretofore and many novel features that result in a rotatable paper roll holder which is not anticipated, rendered obvious, suggested, or even implied by any of the prior art roll holding devices, either alone or in any combination thereof.

It is another object of the present invention to provide a new rotatable paper roll holder which may be easily and efficiently manufactured and marketed.

It is a further object of the present invention to provide a new rotatable paper roll holder which is of a durable and reliable construction.

An even further object of the present invention is to provide a new rotatable paper roll holder which is susceptible of a low cost of manufacture with regard to both materials and labor, and which accordingly is then susceptible of low prices of sale to the consuming public, thereby making such rotatable paper roll holders economically available to the buying public.

Still yet another object of the present invention is to provide a new rotatable paper roll holder which provides in the apparatuses and methods of the prior art some of the advantages thereof, while simultaneously overcoming some of the disadvantages normally associated therewith.

Still another object of the present invention is to provide a new rotatable paper roll holder for rotatably supporting a roll of paper for dispensing of the paper either from over or from under the roll.

Yet another object of the present invention is to provide a new rotatable paper roll holder which includes a mounting means for securing to a support surface, a yoke supporting a spindle upon which a roll of paper can be rotatably positioned, and an adjustable angle coupling means for securing the yoke to the mounting means and for permitting rotation of the yoke about an axis directed orthogonally through the spindle such that the paper roll can be oriented to unroll paper either from over or from under the roll as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
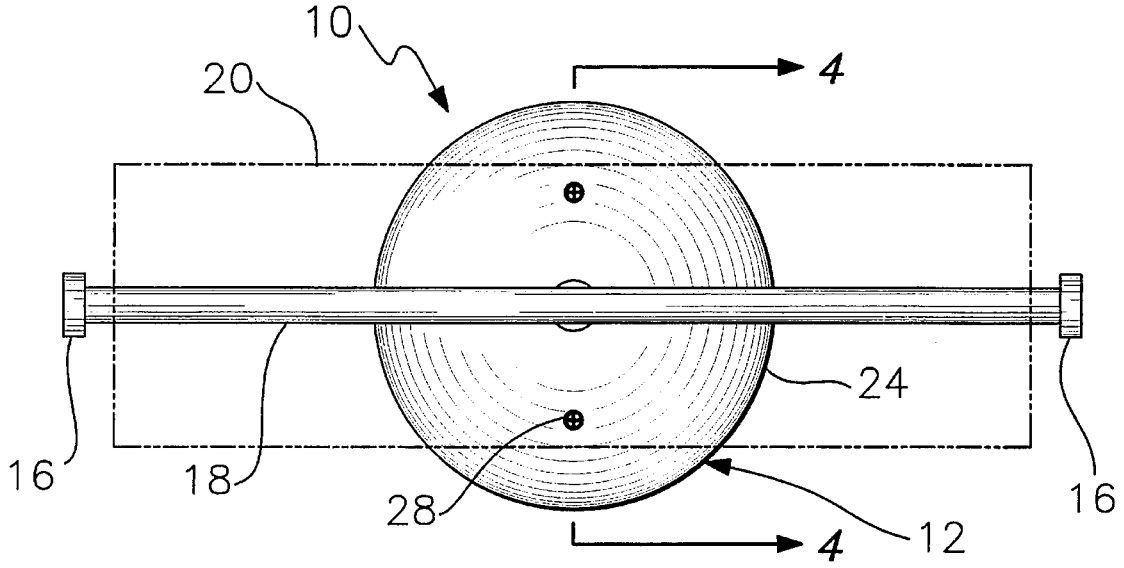
FIG. 1 is a front elevation view of a rotatable paper roll holder according to the present invention.

With reference now to the drawings, and in particular to FIGS. 1–4 thereof, a new rotatable paper roll holder embodying the principles and concepts of the present invention and generally designated by the reference numeral 10 will be described.

Figure 2:
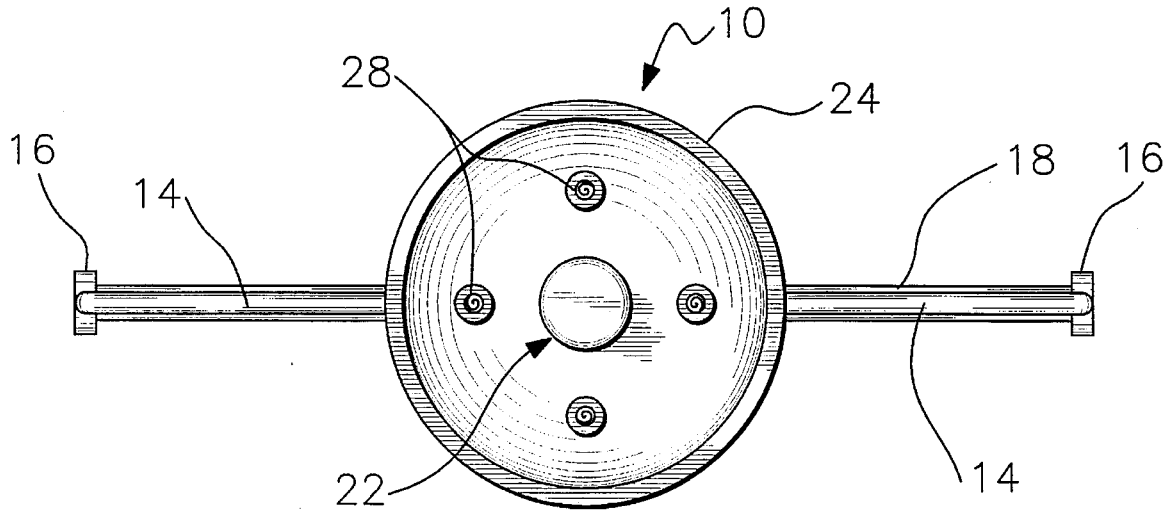
FIG. 2 is a rear elevation view of the present invention.
Figure 3:
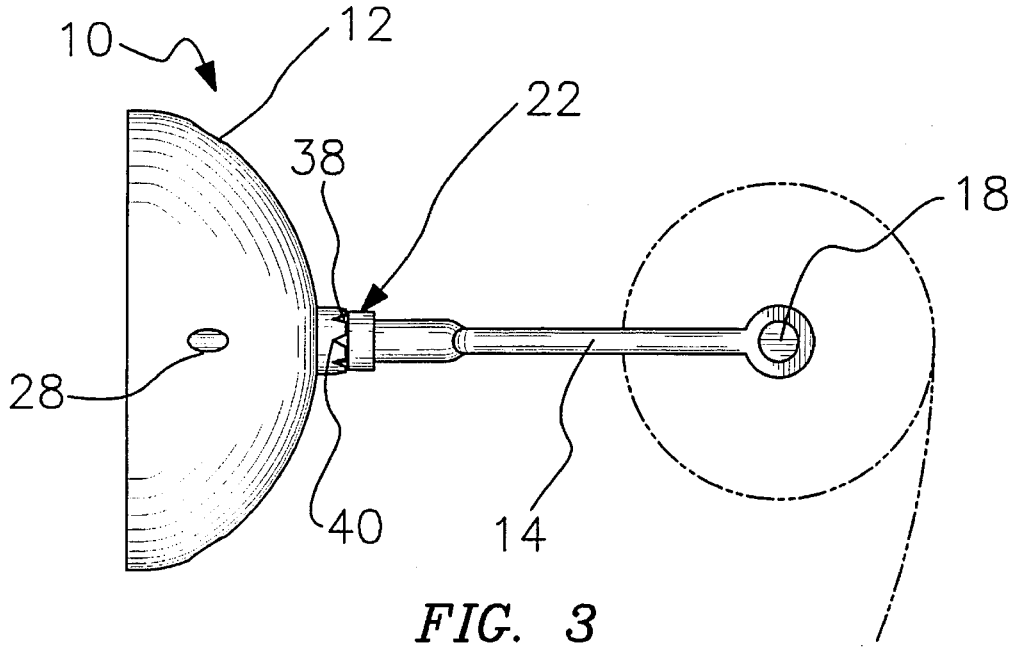
FIG. 3 is a side elevation view of the invention.
Figure 4:
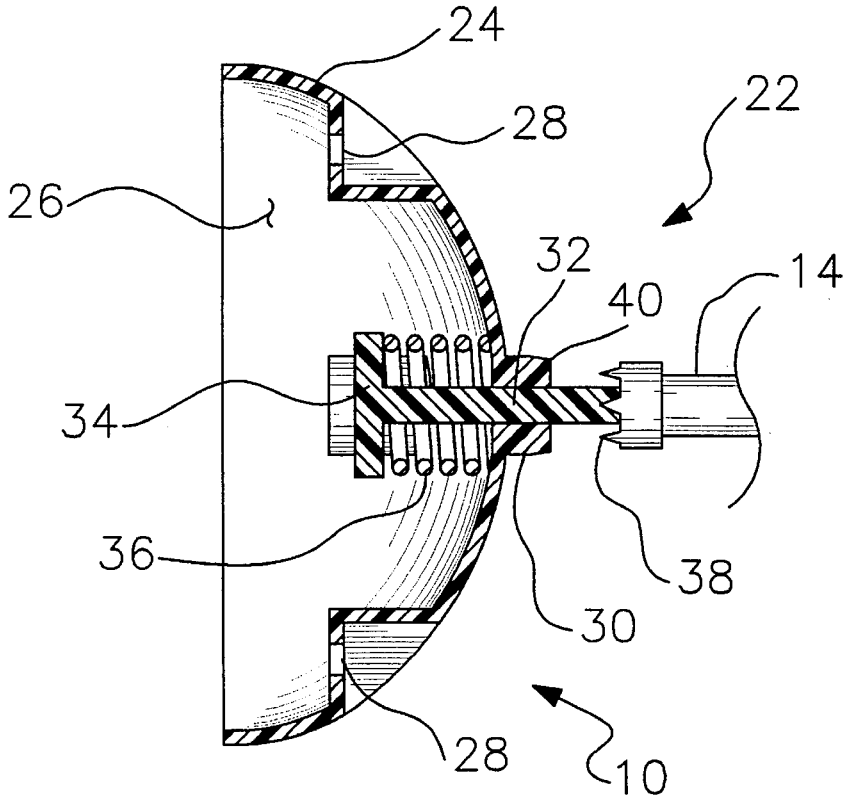
FIG. 4 is a cross sectional view taken along line 4—4 of FIG. 1.

More specifically, it will be noted that the rotatable paper roll holder 10 comprises a mounting means 12 for securing to a support surface such as a vertical wall within a bathroom, kitchen, or like structure. A yoke 14 includes spaced lateral yoke arms 16 between which a spindle 18 is removably positioned and retained therebetween by frictional fit, mechanical interference fit, expandable telescoping fit, or the like. The spindle 18 can thus be selectively removed to receive and rotatably support a paper roll 20, such as toilet paper or paper towels, positioned over the spindle and between the yoke arms 16, as shown in FIGS. 1 and 2 of the drawings. As illustrated in FIGS. 3 and 4, an adjustable angle coupling means 22 is interposed between the mounting means 12 and the yoke 14 for supporting the yoke relative to the mounting means 12 and permitting selective rotation about an axis directed through the mounting means 12 and orthogonally intersecting a longitudinal axis of the spindle 18. By this structure, the paper roll 20 can be rotated by an end user so as to dispense paper from the roll either from over or from under the paper roll 20.

Referring to FIGS. 1 and 2, it can be shown that the mounting means 12 according to the present invention 10 preferably comprises a mounting boss 24 defining a hollow interior 26 (see FIG. 4). A plurality of mounting apertures 28 are directed through the mounting boss 24 for permitting passage of fasteners securable to the support surface or vertical wall. By this structure, the present invention 10 can be easily secured to the exterior surface of a vertical wall within a bathroom or kitchen.

Referring now to FIGS. 3 and 4, it can be shown that the adjustable angle coupling means 22 preferably comprises an axle guide 30 projecting from the mounting boss 24 and positioned over an unlabeled axle aperture extending through the mounting boss. An axle 32 projects from the yoke 14 and extends through the axle guide 30 and into the hollow interior 26 of the mounting boss 24 so as to rotatably mount the yoke relative to the mounting means 12. An end cap 34 is secured to a free distal end of the axle 32 within the hollow interior 26 of the mounting boss 24. A spring 36 interposed between the end cap 34 and an interior surface of the mounting boss 24 biases the yoke 14 against an exterior surface of the axle guide 30. The yoke 14 may simply frictionally engage the exterior surface of the axle guide 30 so as to retain a position of the yoke relative to the mounting means 12. However, the adjustable angle coupling means 22 preferably further comprises a plurality of radially spaced projections 38 extending from the yoke 14 and being received within a plurality of detents 40 formed into the axle guide 30 so as to positively lock the yoke 14 relative to the axle mount 30 and the associated mounting means 12. Thus, an individual desiring to rotate the yoke 14 relative to the mounting boss 24 of the mounting means 12 can simply pull the yoke 14 and associated axle 32 from the axle guide 30 against a force of the spring 36 so as to remove the projections 38 from the detents 40, whereby rotation of the yoke can then be accomplished to position the paper roll in a desired orientation.

In use, the rotatable paper roll holder according to the present invention can be easily utilized to support a roll of paper or other material web in a desired orientation for permitting ease of dispensing of the paper or web from the roll.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rotatable paper roll holder comprising:

a mounting means for securing said roll holder to a support surface;

a yoke including spaced lateral yoke arms;

a spindle removably positioned between the lateral yoke arms of the yoke;

an adjustable angle coupling means interposed between the mounting means and the yoke for supporting the yoke relative to the mounting means and permitting selective rotation of the yoke about an axis directed through the mounting means and orthogonally intersecting a longitudinal axis of the spindle, wherein the mounting means comprises a mounting boss defining a hollow interior with the adjustable angle coupling means being secured to the mounting boss, and wherein the mounting boss includes an axle aperture directed therethrough, and further wherein the adjustable angle coupling means comprises an axle guide projecting from the mounting boss and positioned over the axle aperture extending through the mounting boss; an axle projecting from the yoke and extending through the axle guide and into the hollow interior of the mounting boss; an end cap secured to a free distal end of the axle within the hollow interior of the mounting boss; a spring interposed between the end cap and an interior surface of the mounting boss for biasing the yoke against an exterior surface of the axle guide.

2. The rotatable paper roll holder of claim 1, wherein the mounting boss includes a plurality of mounting apertures directed therethrough for permitting passage of fasteners securable to said support surface.

3. The rotatable paper roll holder of claim 1, wherein the axle guide is shaped so as to define a plurality of detents, and further wherein the adjustable angle coupling means further comprises a plurality of radially spaced projections extending from the yoke and being received within the plurality of detents formed into the axle guide so as to lock the yoke against rotation relative to the axle mount and the mounting means, whereby the axle can be pulled from the axle guide against a force of the spring so as to remove the projections from the detents to permit rotation of the yoke relative to the mounting means.

4. A method of reversing a roll of paper from dispensing from over the roll to dispensing from under the roll, the method comprising the steps of:

providing a rotatable paper roll holder comprising: a mounting means for securing to a support surface, a yoke including spaced lateral yoke arms, a spindle removably positioned between the lateral yoke arms of the yoke, and an adjustable angle coupling means interposed between the mounting means and the yoke for supporting the yoke relative to the mounting means and permitting selective rotation of the yoke about an axis directed through the mounting means and orthogonally intersecting a longitudinal axis of the spindle;

providing a roll of paper;

positioning the roll of paper about the spindle such that the paper hangs from over the roll;

pulling the yoke away from the mounting means;

rotating the yoke relative to the mounting means;

releasing the yoke towards the mounting means.

5. The method of claim 4, wherein the step of rotating the yoke relative to the mounting means comprises:

rotating the yoke through a one hundred and eighty degree are relative to the mounting means.

* * * * *